US007902412B2

(12) United States Patent
Senetar et al.

(10) Patent No.: US 7,902,412 B2
(45) Date of Patent: Mar. 8, 2011

(54) USE OF OLEFIN CRACKING TO PRODUCE ALKYLATE

(75) Inventors: John J. Senetar, Naperville, IL (US); David A. Wegerer, Lisle, IL (US); Gavin P. Towler, Inverness, IL (US)

(73) Assignee: UOP LLC, Des Plaines, IL (US)

( * ) Notice: Subject to any disclaimer, the term of this patent is extended or adjusted under 35 U.S.C. 154(b) by 859 days.

(21) Appl. No.: 11/781,497

(22) Filed: Jul. 23, 2007

(65) Prior Publication Data

US 2009/0030251 A1 Jan. 29, 2009

(51) Int. Cl.
*C07C 2/56* (2006.01)
*C07C 4/02* (2006.01)

(52) U.S. Cl. ..... 585/331; 585/324; 585/332; 585/648; 585/717

(58) Field of Classification Search ..... 585/331, 585/324, 332, 648, 717
See application file for complete search history.

(56) References Cited

U.S. PATENT DOCUMENTS

| | | | | |
|---|---|---|---|---|
| 3,925,500 | A | 12/1975 | Wentzheimer | |
| 4,056,578 | A | 11/1977 | McClure et al. | 260/683.47 |
| 4,773,375 | A | 9/1988 | Okino et al. | 123/488 |
| 5,294,328 | A | 3/1994 | Schmidt et al. | 208/66 |
| 5,347,064 | A | 9/1994 | Child et al. | 585/716 |
| 5,475,175 | A | 12/1995 | Husain et al. | |
| 5,498,817 | A | 3/1996 | Huang et al. | 585/709 |
| 5,831,139 | A | 11/1998 | Schmidt et al. | 585/315 |
| 6,320,089 | B1 | 11/2001 | Gillespie | 585/744 |
| 6,333,442 | B1 | 12/2001 | Cosyns et al. | |
| 6,844,479 | B2 | 1/2005 | Yeh et al. | 585/643 |
| 7,160,831 | B2 | 1/2007 | Vaughn et al. | 502/64 |
| 7,166,556 | B1 | 1/2007 | Vanderveen et al. | 502/216 |
| 2004/0087824 | A1 * | 5/2004 | O'Rear et al. | 585/651 |

* cited by examiner

*Primary Examiner* — Thuan Dinh Dang
(74) *Attorney, Agent, or Firm* — Arthur E Gooding

(57) ABSTRACT

A process for producing a feedstock for gasolines having very little aromatic concentrations is disclosed. The present process uses by-product olefins and alkanes to produce an alkylate for use in gasoline blending.

9 Claims, 2 Drawing Sheets

USE OF OLEFIN CRACKING TO PRODUCE ALKYLATE

FIELD OF THE INVENTION

This invention relates to an improved process combination for the conversion of hydrocarbons, and more specifically for the selective production of alkylate as intermediates for production of gasoline.

BACKGROUND OF THE INVENTION

Fuel quality demands and environmental concerns have led to the widespread removal of antiknock additives containing lead, and to the subsequent reformulation of gasoline. Because of the demands of modern internal-combustion engines, refiners have had to modify processes and install new processes to produce gasoline feedstocks that contribute to increasing the "octane," or autoignition resistance. Premature autoignition causes the "knock" in internal combustion engines. Refiners have used a variety of processes to upgrade the gasoline feedstocks, including higher fluid catalytic cracking (FCC), isomerization of light naphtha, higher severity catalytic reforming, and the use of oxygenated compounds. Some of these processes produce higher octane gasoline feedstocks by increasing the aromatics content of the gasoline at the expense of reducing the content low-octane paraffins. Gasolines generally have aromatics contents of about 30% or more.

Faced with tightening automotive emission standards, refiners are having to supply reformulated gasoline to meet the stricter standards. Requirements for the reformulated gasoline include lower vapor pressure, lower final boiling point, increased oxygenate content, and lower content of olefins and aromatics. Aromatics, in particular benzene and toluene, have been the principal source of increasing the octane of gasoline with the removal of lead compounds, but now the aromatics content may eventually be reduced to less than 25% in major urban areas and to even lower ranges, such as less than 15%, in areas having severe pollution problems.

Alternate formulations for gasolines have been comprising aliphatic-rich compositions in order to maintain the octane ratings, as refiners have worked to reduce the aromatic and olefin content of gasolines. Currently, the processes for increasing the aliphatic content of gasolines include the isomerization of light naphtha, isomerization of paraffins, upgrading of cyclic naphthas, and increased blending of oxygenates. However, oxygenates are also becoming an issue as the use of methyl tertiary-butyl ether (MTBE) is being phased out, and ethanol has become the primary oxygenate for use with gasoline.

New technology, and processes can increase the production of alkylates for gasoline blending to reduce the aromatic content. Adding a complementary unit to process butenes to existing refinery process units provides a convenient upgrade, while improving the economic returns of a refinery with a minimal capital cost, and increases the flexibility of a refinery to shifting product demands.

SUMMARY OF THE INVENTION

The invention provides a process for increasing the amount of alkylate for use in gasoline blending. The process comprises recovering the butenes generated in an olefin cracking process and reacting the butenes with a C4+ effluent stream, comprising alkanes and alkenes, generated from a process for cracking higher molecular weight hydrocarbons. The process comprises combining an alkylation reactor with an olefin cracking process and adding the combination to a cracking process. The butenes are recovered from an olefin cracking process, while other heavier components are recycled for further cracking. The operating conditions can be controlled to increase butene yields and the butenes are passed to an alkylation reactor, to react with the C4+ effluent stream from the cracking unit. The alkylation reactor generates an alkylate product stream comprising branched alkanes having from 5 to 12 carbon atoms, thereby producing a high quality product stream for gasoline blending.

Other objects, advantages and applications of the present invention will become apparent to those skilled in the art from the following detailed description.

DETAILED DESCRIPTION OF THE INVENTION

Figure 1:
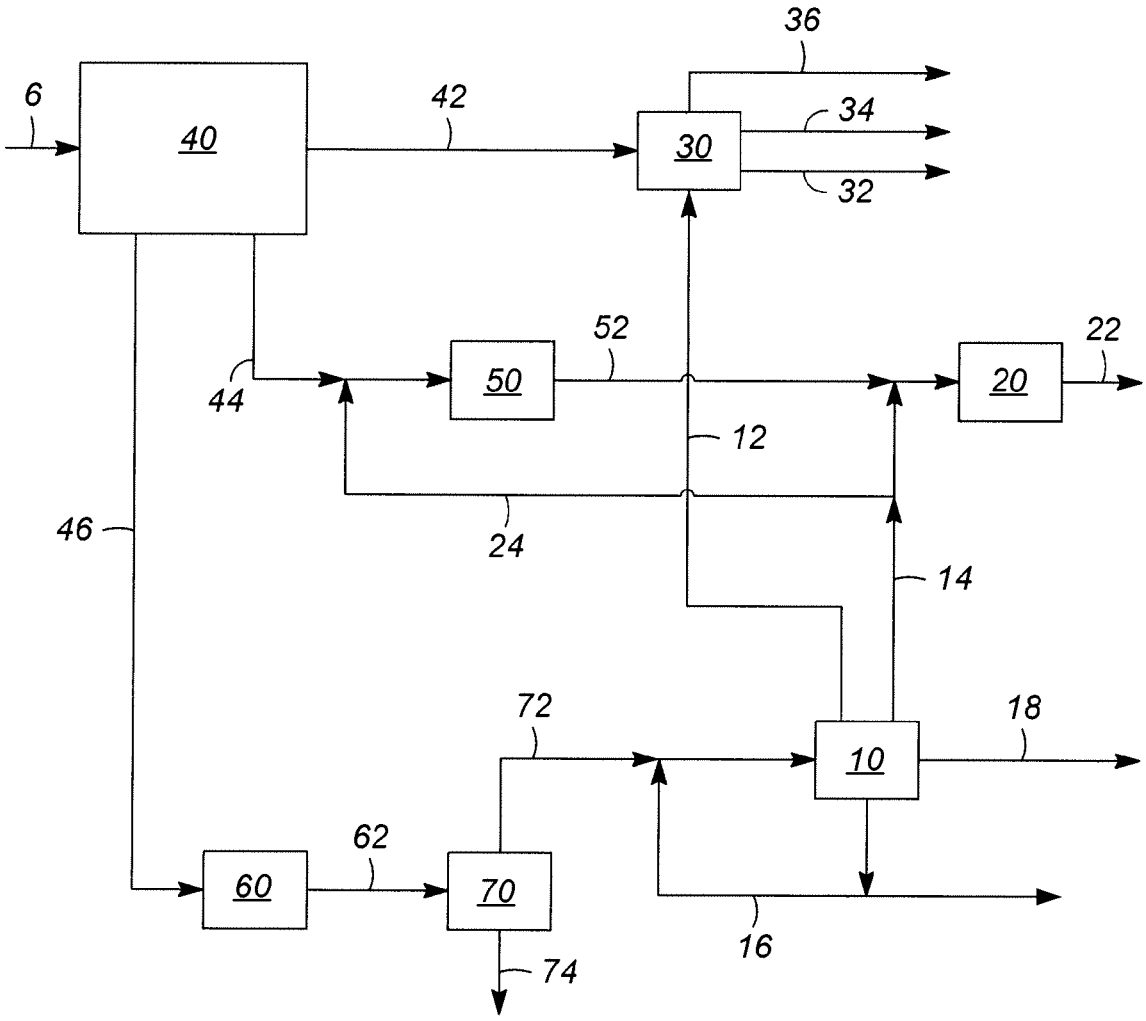
FIG. 1 is a configuration for the process of the invention with a naphtha cracking unit.

Olefin cracking (OC) technology was developed to convert larger (C4+) olefins to ethylene and propylene. However, in the OC process, butenes are produced which can be separated out or recycled for further cracking. The quantity of butenes produced in the olefin cracking process (OCP) can be has high as 40 wt % based on the total olefins fed to the OCP. Usually, butenes are recycled to be further cracked to produce ethylene. Olefin cracking technology was developed to work with other processes, such as a naphtha cracker, or a fluidized catalytic cracker (FCC), where heavier olefins, C4 to C8 olefins, were separated from the product stream and routed to the olefin cracker to increase ethylene and propylene production.

Likewise, naphtha crackers are designed for producing ethylene and propylene through cracking of larger gasoline range paraffinic and naphthenic molecules to generate an olefin stream rich in ethylene and propylene, and other by-products. The by-products include butenes, butanes, and butadienes. Usually, the butanes, butenes, and butadienes, or C4s, are either directed to OCP units for further cracking, or are separated and used for various polymers using the butene or butadiene monomers, or the production of methyl tertiary butyl ether (MTBE), or even as a fuel. Yet, the C4s are useful as a precursor and can be processed to produce an alkylate. The C4 stream is also lean in aromatics, so the processing will produce a high value alkylate product for use in gasoline blending.

With the demand for cleaner gasoline, the production of isoalkylates can produce a cleaner gasoline while reducing the aromatic content and maintaining the octane rating. In a refinery, gasoline tends to be a primary product, and can be increased from effluent streams resulting from cracking units that are designed to produce light olefins. For example, the OCP can be altered to increase, rather than decrease, the amount of C4 olefins. The C4 olefins comprise 1-butene, 2-butene and isobutene. By removing the butenes on each reactor pass of the process stream, and only recycling C5+ olefins to be cracked into ethylene and propylene, the production of alkylate from the C4 olefins can be increased. The production of alkylate can be used to produce high quality, low aromatic gasolines.

The process of the present invention can be integrated into existing cracking processes and is a method of producing alkylate from an olefin cracking process. The process stream from an olefin cracking process comprises butenes, which are separated out before recycling a C5+ rich stream for recycle to the olefin cracking process. The result is to increase the quantity of high value ethylene, propylene, and C4 olefins, while reducing the low value C5+ olefins. The butene stream is passed to an alkylation unit where the butenes are reacted with an alkane stream passed to the alkylation unit. The alkylation unit generates an alkylate product stream comprising branched alkanes having 5 to 12 carbon atoms. Because the feed streams to the alkylation unit comprise mostly butenes and butanes, the alkylate can comprise a product with greater than 30 mole % branched C8 alkanes, and preferably with a product stream of greater than 40 mole % branched C8 alkanes. Preferably, the alkane stream comprises alkanes having 3 to 8 carbon atoms, and preferably the C4+ alkanes are isoalkanes.

The reaction conditions of the alkylation unit include temperatures between 40° C. and about 120° C., pressures between 350 kPa (50 psia) and 4.2 MPa (600 psia), and a weight hourly space velocity (WHSV) between 0.1 $hr^{-1}$ and 30 $hr^{-1}$. Preferably, the WHSV is between 1 $hr^{-1}$ and 10 $hr^{-1}$. Catalysts for alkylation include liquid catalysts such as sulfuric acid and hydrofluoric acid and solid acids such as chlorided alumina, aluminosilicates and aluminophosphates.

This process and equipment can be inserted into a refinery operation as an addition to the olefin cracking process to provide flexibility to the product mix of the refinery.

In one embodiment, the process is added after the OCP with a naphtha cracking unit, as shown in FIG. 1. An olefin cracking process 10 generates a light olefin stream 12 comprising ethylene and propylene. The OCP 10 also generates butenes and C5+ hydrocarbons. Included in the OCP 10 is a separation unit for separating butenes from C5+ hydrocarbons. The butene stream 14 is passed to an alkylation reaction unit 20. The alkylation unit 20 produces a high quality alkylate stream 22 from the butenes and butanes that are generated from the OCP 10. A portion of the C5+ hydrocarbon stream 16 is recycled to the OCP. The ethylene and propylene are passed to a separation unit 30 to separate propylene 32, ethylene 34, and other light gases 36. The OCP also generates a heavy hydrocarbon stream 18 that can be recycled to a naphtha cracking unit 40, passed to gasoline blending, or other processing units in the petro-chemical plant. The naphtha cracking unit 40 receives as a feed 6, a naphtha boiling point range feedstock, and recycled streams having constituents in the naphtha boiling point range. The yield of C4 olefins can be maximized in the OCP 10 by recycling the C5+ olefins within the OCP 10. As the olefins are depleted from the recycle stream 16, the heavy constituents are purged and recycled back to the naphtha cracking unit 40.

In an alternate embodiment, stream 14 from the OCP is not separated from stream 16, and stream 16 is passed to the alkylation unit 20. Stream 16 comprises butenes and pentenes, and can be reacted with light iso-alkanes to form alkylates comprising C8s in the alkylate stream 22.

The naphtha cracking unit 40 generates a light olefin stream 42 comprising ethylene and propylene which is passed to the light olefin separation unit 30. In addition, the naphtha cracking unit 40 generates a by product known as pyrolysis gasoline (pygas). The pygas can be separated from the light olefins by a water quench stage. The pygas is a mixture of light hydrocarbons which is highly olefinic and includes butanes, butenes, other alkanes, olefins, diolefins, aromatics, such as benzene and toluene, and naphthenes. The pygas can be separated to generate a butane rich stream 44 comprising butanes, butenes, butadienes, and some amounts of larger alkanes and olefins, and a pygas stream 46 comprising the aromatics, naphthenes and larger alkanes and olefins. The butane rich stream 44 can comprise alkanes having from 3 to 8 carbon atoms, and preferably with isoalkanes and some olefins.

In an alternate embodiment of the present invention with the naphtha cracking unit 40, the butane rich stream 44 is passed to a selective hydrogenation unit 50 to selectively hydrogenate butadienes and to isomerize butenes. The isomerization of butenes is to increase the 2-butene to 1-butene ratio. The butadienes are hydrogenated to butanes and butenes, and a hydrogenated butane rich stream 52 is passed to the alkylation reaction unit 20, for reaction to produce the alkylate stream 22. Depending on the amount of diolefins produced in the OCP 10, the butene stream 14 can be partially, or entirely, passed through stream 24 to the selective hydrogenation unit 50 to hydrogenate diolefins.

The pygas stream 46 can be passed to a pygas selective hydrogenation unit 60 where the aromatics and the naphthenes are hydrogenated, thereby generating an intermediate stream 62 reduced in aromatics and naphthenes. The intermediate product stream 62 can be separated in a depentanizer 70 to recover a C5 stream 72 comprising pentanes and pentenes, and a recycle stream 74. The C5 stream 72 is passed to the OCP 10 to generate more light olefins, i.e. ethylene and propylene. The light olefins are passed to a separation unit 30 for separation into product streams of ethylene 34 and propylene 32. The OCP 10 also generates butenes which are passed in a butene stream 14 to the alkylation reactor 20. The recycle stream 74 is passed to a secondary hydrogenation unit (not shown) for further hydrogenation of aromatics, and recycle to the naphtha cracking unit 40. Alternately, stream 74 can be directed to recover aromatics, a valuable petrochemical byproduct for use in xylene production or alkyl-aromatics production.

Figure 2:
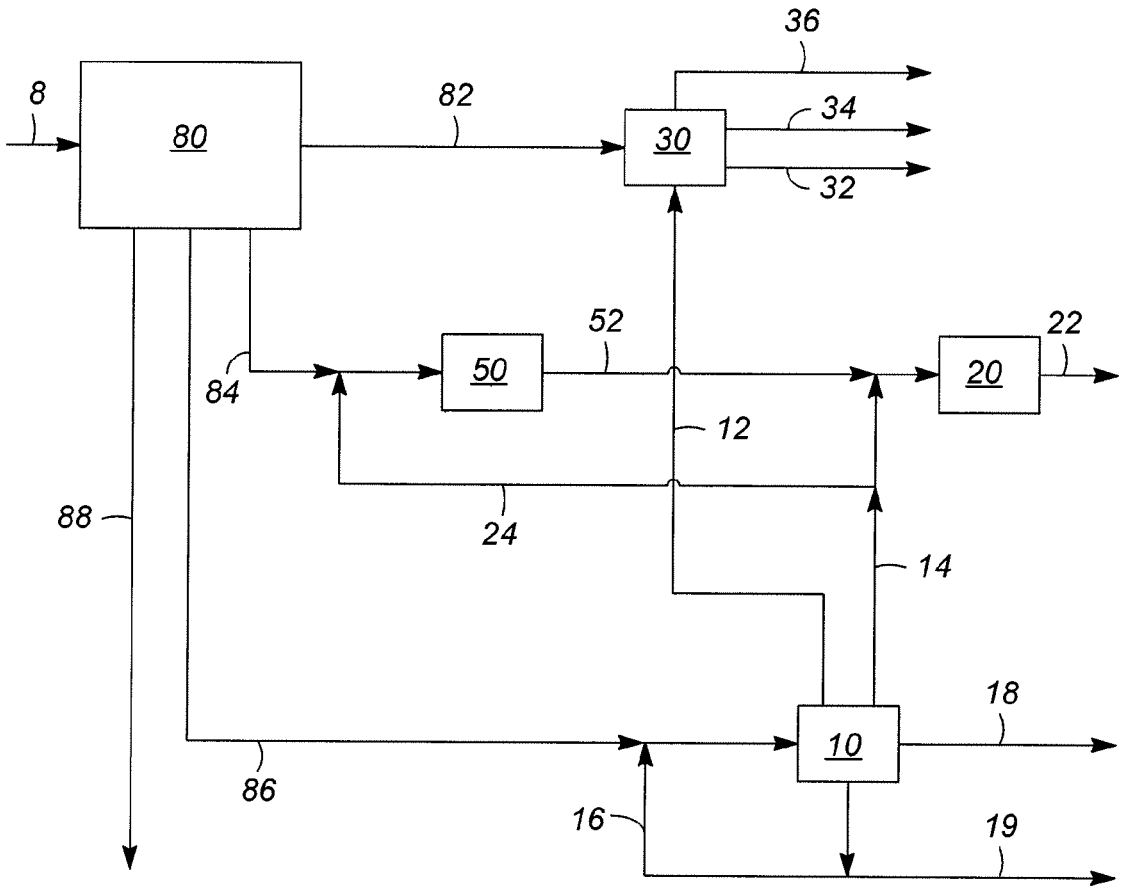
FIG. 2 is a configuration for the process of the invention with a fluid catalytic cracking unit.

In another embodiment, the process is added after an OCP 10 with a fluidized catalytic cracking (FCC) unit 80, as shown in FIG. 2. The FCC 80 receives a gas oil feedstock 8 and generates a light olefin stream 82 which is passed to a separation unit 30 to generate an ethylene stream 34, a propylene stream 32, and other light gases 36. The FCC unit also generates a C4 stream 84, comprising butenes and butanes, and passes the C4 stream 84 to the alkylation unit 20. In addition, the FCC unit 80 generates a C5+ hydrocarbon stream 86 comprising C5 and C6 olefins. The C5+ hydrocarbon stream 86 is passed to the OCP 10 where the olefins are cracked to produce light olefin product 12, comprising ethylene and propylene; a butene stream 14, comprising butenes and butanes; a recycle stream 19, comprising C5s and C6s where a portion of the stream 19 can be recycled to the OCP, a portion of the stream 19 can be recycled to the FCC unit 80, and a portion of the stream 19 is purged and used for gasoline blending; and a heavy hydrocarbon stream 18 that can be recycled to a FCC unit 80, or other processing units in the petro-chemical plant. The FCC unit 80 also generates a C7+ stream 88 that can be passed to other processing units.

In an alternate embodiment, the C4 stream 84 can be passed to a selective hydrogenation unit 50 to selectively hydrogenate butadienes and to isomerize butenes to increase the 2-butene to 1-butene ratio. The butadienes are hydrogenated to butanes and butenes, and a hydrogenated butane rich stream 52 is passed to the alkylation reaction unit 20, for reaction to produce the alkylate stream 22. Depending on the amount of diolefins produced in the OCP 10, the butene stream 14 can be partially, or entirely, passed through stream 24 to the selective hydrogenation unit 50 to hydrogenate diolefins and to isomerizes butenes.

While the invention has been described with what are presently considered the preferred embodiments, it is to be understood that the invention is not limited to the disclosed embodiments, but it is intended to cover various modifications and equivalent arrangements included within the scope of the appended claims.

The invention claimed is:

1. A process for producing alkylate comprising:

separating butenes from a process stream from an olefin cracking process, thereby creating a C5+ rich stream for recycle to the olefin cracking process and a butene stream;

passing the butene stream to an alkylation unit;

passing an alkane stream, comprising alkanes and olefins, wherein the alkane stream is a C4 rich stream from a cracking unit, to a selective hydrogenation unit to selectively hydrogenate butadienes and isomerizes butenes;

passing the hydrogenated stream to an alkylation unit;

reacting the butenes and alkanes in the alkylation unit at reaction conditions, thereby generating an alkylate product stream comprising branched alkanes with 5 to 12 carbon atoms;

purging a heavy stream, comprising C4+ paraffinic hydrocarbon components from the olefin cracking process; and passing the purged heavy stream to a naphtha cracking unit.

2. The process of claim 1 wherein the alkanes have from 3 to 8 carbon atoms.

3. The process of claim 1 wherein the alkylate product stream comprises more than 30 mole % branched C8 alkanes.

4. The process of claim 3 wherein the alkylate product stream comprises more than 40 mole % branched C8 alkanes.

5. The process of claim 1 wherein the alkylation reaction conditions include a temperature between 40° C. and 120° C.

6. The process of claim 1 wherein the alkylation reaction conditions include a pressure between 350 kPa (50 psia) and 4.2 MPa (600 psia).

7. The process of claim 1 wherein the alkylation reaction conditions include an acidic catalyst in the alkylation unit and a WHSV between 0.1 $hr^{-1}$ and 30 $hr^{-1}$.

8. The process of claim 7 wherein the WHSV is between 0.5 $hr^{-1}$ and 10 $hr^{-1}$.

9. The process of claim 1 wherein the cracking unit is a naphtha cracking unit or an FCC unit.

* * * * *